US007043045B2

(12) United States Patent
Takahashi

(10) Patent No.: US 7,043,045 B2
(45) Date of Patent: May 9, 2006

(54) SPEAKER

(75) Inventor: Osamu Takahashi, Tendo (JP)

(73) Assignees: Pioneer Corporation, Tokyo (JP); Tohoku Pioneer Corporation, Yamagate (JP)

( * ) Notice: Subject to any disclaimer, the term of this patent is extended or adjusted under 35 U.S.C. 154(b) by 135 days.

(21) Appl. No.: 10/410,265

(22) Filed: Apr. 10, 2003

(65) Prior Publication Data

US 2003/0202674 A1 Oct. 30, 2003

(30) Foreign Application Priority Data

Apr. 30, 2002 (JP) ..... 2002-129054

(51) Int. Cl.
*H04R 25/00* (2006.01)

(52) U.S. Cl. ..... 381/398; 381/391; 381/189; 381/423

(58) Field of Classification Search ..... 381/386, 381/391, 189, 396, 398, 430, 431, 432, 433, 381/423; 181/171, 172, 173
See application file for complete search history.

(56) References Cited

U.S. PATENT DOCUMENTS 5,949,898 A * 9/1999 Proni ..... 381/398
6,751,332 B1 * 6/2004 Kobayashi et al. ..... 381/386

* cited by examiner

*Primary Examiner*—Huyen Le
(74) *Attorney, Agent, or Firm*—Sughrue Mion, PLLC

(57) ABSTRACT

An edge damper frame 18*b* is disposed in between a part of an outer peripheral surface 20*a* of a frame-cover 20 and a leveling surface 14*c*-1 of a frame 14. A slope 18*e* of a diaphragm 15 is extended from the edge damper frame 18*b* toward the frame 14 and provided alongside an outer side surface 14*c*-2 of a convex portion 14*c* of the frame 14.

13 Claims, 2 Drawing Sheets

SPEAKER

BACKGROUND OF THE INVENTION

1. Field of the Invention

This invention relates to a speaker and a diaphragm for use in speaker, and more particularly to a speaker of which peripheries of a diaphragm and a top-cover are supported by a frame and to the diaphragm for use in speaker.

2. Description of the Related Art

Heretofore, a dome speaker shown in FIGS. 2A and 2B is proposed as an example of above described speaker. FIG. 2A shows an exploded half-sectional view of the dome speaker. FIG. 2B shows a half-sectional view of the dome speaker.

As shown in FIGS. 2A and 2B, in the dome speaker, a magnetic circuit with a ring-shaped gap is composed of a disk-shaped pole-plate 10, a magnet 11 and a yoke 12. The magnetic gap 13 is a gap between a side surface of the pole-plate 10 and the yoke 12, with a substantially same interval throughout a circumference of the gap 13. Moreover, a frame 14 made of such as synthetic resin is formed integrally outside the yoke 12 composing the magnetic circuit. A frame assembly is composed of the frame 14 and the magnetic circuit.

Further, a diaphragm 15 with a substantially circle or oval shape in a plane view is disposed over the frame assembly. The diaphragm 15 includes a dome shaped vibrating portion 16, a concave portion 17 with a U-shaped section provided at an outer peripheral edge of the vibrating portion 16, an edge damper 18*a* provided at an outer peripheral edge of the concave portion 17, and an edge damper frame 18*b* provided at an outer peripheral edge of the 18*a* and having a surface in level to a radial direction of the 18*a*. The edge damper frame 18*b* is provided alongside a leveling surface 14*b* on top of the frame 14.

Moreover, the diaphragm 15 includes a rising portion 18*c* being provided at an outer peripheral edge of the edge damper frame 18*b* and rising substantially perpendicular to the outer peripheral edge integrally. The rising portion 18*c* is provided alongside an inner side surface 14*a*-1 of a convex portion 14*a* provided outside the leveling surface 14*b* of the frame 14. Furthermore, the diaphragm 15 includes a locking portion 18*d* being provided at a top of the rising portion 18*c* and having a surface in level to a radial direction of the diaphragm 15 outwardly. The locking portion 18*d* is provided to abut against an inner side surface 14*a*-2 of the convex portion 14*a*.

Incidentally, an edge 18 is composed of the edge damper 18*a*, the edge damper frame 18*b*, the rising portion 18*c* and the locking portion 18*d*. Moreover, the diaphragm 15 is composed of the vibrating portion 16, the concave portion 17 and the edge 18 being formed integrally by such as hot press molding a sheet of synthetic resin film.

In such structure, when the rising portion 18*c* is located alongside the inner side surface 14*a*-1 of the convex portion 14*a* provided on the frame 14, centers of the diaphragm 15 and the frame assembly are aligned with no misalignment, so that the diaphragm 15 is to be attached to the frame assembly in the correct position. In other words, the rising portion 18*c* locates a position of the diaphragm 15 corresponding to the frame 14 in radial direction.

Further, when the edge damper frame 18*b* is located alongside the leveling surface 14*b* of the frame 14, the concave portion 17 is not located outside the magnetic gap 13, so that the diaphragm 15 is to be attached to the frame assembly in the correct position. In other words, the edge damper frame 18*b* locates a position of the diaphragm 15 corresponding to the frame 14 in perpendicular direction.

Therefore, the concave portion 17 can be located floatingly at a correct position in the magnetic gap 13 of the magnetic circuit. A voice coil 19 made of wound electrical wire is adhered to the concave portion 17. Therefore, the voice coil 19 and the concave portion 17 are located in the magnetic gap 13 of the magnetic circuit by the edge damper 18*a* to be supported resiliently. Moreover, with locking portion 18*d* abutting against the inner side surface 14*a*-2 of the convex portion 14*a*, the diaphragm 15 is supported more firmly.

Moreover, a frame-cover 20 for protecting the diaphragm 15 is provided over the diaphragm 15. An outer peripheral surface 20*a* of the frame-cover 20 is located nearer to the diaphragm 15 than an inner surface 20*b*. Further, a locking portion 20*c*, falling substantially perpendicular to the outer peripheral surface 20*a* integrally, is provided at an outer peripheral edge of the outer peripheral surface 20*a*. A part of the outer peripheral surface 20*a* of the frame-cover 20 is supported by a leveling surface 14*a*-3 provided at a top of the convex portion 14*a*. Further, the locking portion 20*c* abuts against an outer side surface 14*a*-4 of the convex portion 14*a*, so that the frame-cover 20 is supported more firmly.

Incidentally, in general, the larger a vibration area of the diaphragm 15 becomes, the more advantage a speaker has when playing with sufficient sound volume in low frequency band (base range). It is because the larger the vibration area of the diaphragm is, the heavier mass of the diaphragm becomes, so that the lowest resonance frequency (fo) can be set up lower. It is also because the larger the vibration area of the diaphragm becomes, the higher radiation impedance becomes and the higher sensitive sound pressures becomes.

However, in the dome speaker as described above, the leveling surface 14*b* for supporting the diaphragm 15 and the leveling-surface 14*a*-3 for supporting the frame-cover 20 are provided at different positions of the frame 14 respectively. Therefore, as shown in FIG. 2B, there is a problem that in a diameter of the whole speaker, a part S1 for supporting the diaphragm 15 and the frame-cover 20 becomes larger, a diameter S2, adding the edge damper 18*a* to the vibration portion 16 of the diaphragm 15 which actually vibrates, becomes smaller and resultingly the vibration area becomes smaller.

Further, in the conventional dome speaker as above described, the portion rising portion 18*c* stands up from the edge damper frame 18*b* toward the frame-cover 20. Therefore, for providing a inner side surface of the frame 14 alongside the outer side surface of the rising portion 18*c*, it is necessary to provide the convex portion 14*a* of the frame 14 outward from the outer side surface of the rising portion 18*c* in radial direction.

As shown in FIG. 2B, this also causes the problem that in the diameter of the whole speaker, the part S1 for supporting the diaphragm 15 and the frame-cover 20 becomes larger, the diameter S2, adding the edge damper 18*a* to the vibration portion 16 of the diaphragm 15 which actually vibrates, becomes smaller and resultingly the vibration area becomes smaller.

SUMMARY OF THE INVENTION

This invention has been accomplished to solve the above described problems and an object of this invention is to provide a speaker and a diaphragm for said speaker, said speaker being enable to play in base range with a small minimum resonance frequency and have high sensitive sound pressure by enlarging a vibration area.

In order to attain the object, according to a first aspect of this invention, there is provided a speaker comprising a diaphragm; a frame-cover disposed over the diaphragm for protecting the diaphragm; and a frame placed underneath the diaphragm and the frame-cover, and having a support portion for supporting supporting points of the diaphragm and the frame-cover, said supporting point of the diaphragm being provided at an outer periphery of the diaphragm and being in level to a radial direction of the diaphragm, whereby the supporting point of the diaphragm is disposed in between the supporting point of the frame-cover and the support portion of the frame.

According to the first aspect of this invention, the supporting point of the diaphragm is disposed in between the supporting point of the frame-cover and the support portion of the frame. With such configuration, it is possible to provide a part for supporting the supporting point of the frame-cover parallel to the radial direction and a part for supporting the supporting point of the diaphragm parallel to the radial direction at a same location on the frame. Therefore, since it is not necessary to provide the parts for supporting the supporting points of the diaphragm and the frame-cover at different positions respectively, the vibration area can be provided larger.

According to a second aspect of this invention, there is provided a speaker comprising a diaphragm; a frame-cover disposed over the diaphragm for protecting the diaphragm; and a frame placed underneath the diaphragm and the frame-cover for supporting outer peripheries of the diaphragm and the frame-cover, whereby said frame includes a convex portion against the diaphragm around an outer periphery of the frame, and said diaphragm includes a slope extending from the outer periphery of the diaphragm toward the frame and having an inner side surface alongside an outer side surface of the convex portion of the frame.

According to a fourth aspect of this invention, there is provided a diaphragm comprising a slope being extended from an outer periphery of the diaphragm toward a frame for supporting the diaphragm, and includes an inner side surface alongside an outer side surface of a convex portion of the frame, said convex portion being provided around an outer periphery of the frame against the diaphragm.

According to the second and fourth aspects of this invention, the slope of the diaphragm extends from its outer periphery toward the frame and includes the inner side surface alongside the outer side surface of the convex portion provided at the outer periphery of the frame. With such configuration, it is not necessary for the frame to extend outward from the outer side surface of the slope in radial direction. Thus, the vibration area can be provided larger.

According to a third aspect of this invention, there is provided a speaker comprising: a diaphragm; a frame-cover disposed over the diaphragm for protecting the diaphragm; and a frame placed underneath the diaphragm and the frame-cover, and having a support portion for supporting supporting points of the diaphragm and the frame-cover, said supporting point of the diaphragm being provided at an outer periphery of the diaphragm and being in level to a radial direction of the diaphragm, whereby said frame includes a convex portion against the diaphragm around an outer periphery of the frame, said diaphragm includes a slope extending from the outer periphery of the diaphragm toward the frame and having an inner side surface alongside an outer side surface of the convex portion of the frame, the support portion of the frame is provided at a top of the convex portion, and the supporting point of the diaphragm is disposed in between the supporting point of the frame-cover and the support portion of the frame.

According to the third aspect of this invention, the supporting point of the diaphragm is disposed in between the supporting point of the frame-cover and the supporting portion provided at the top of the convex portion of the frame. With such configuration, it is possible to provide a part for supporting the supporting point of the frame-cover parallel to the radial direction and a part for supporting the supporting point of the diaphragm parallel to the radial direction at a same location on the frame. Therefore, since it is not necessary to provide the parts for supporting the supporting points of the diaphragm and the frame-cover at different positions respectively, the vibration area can be provided larger.

Further, the slope of the diaphragm extends from its outer periphery toward the frame and includes the inner side surface alongside the outer side surface of the convex portion of the frame. With such configuration, it is not necessary for the frame to extend outward from the outer side surface of the slope in radial direction. Thus, the vibration area can be provided larger.

DESCRIPTION OF THE PREFERRED EMBODIMENT

Figure 1A:
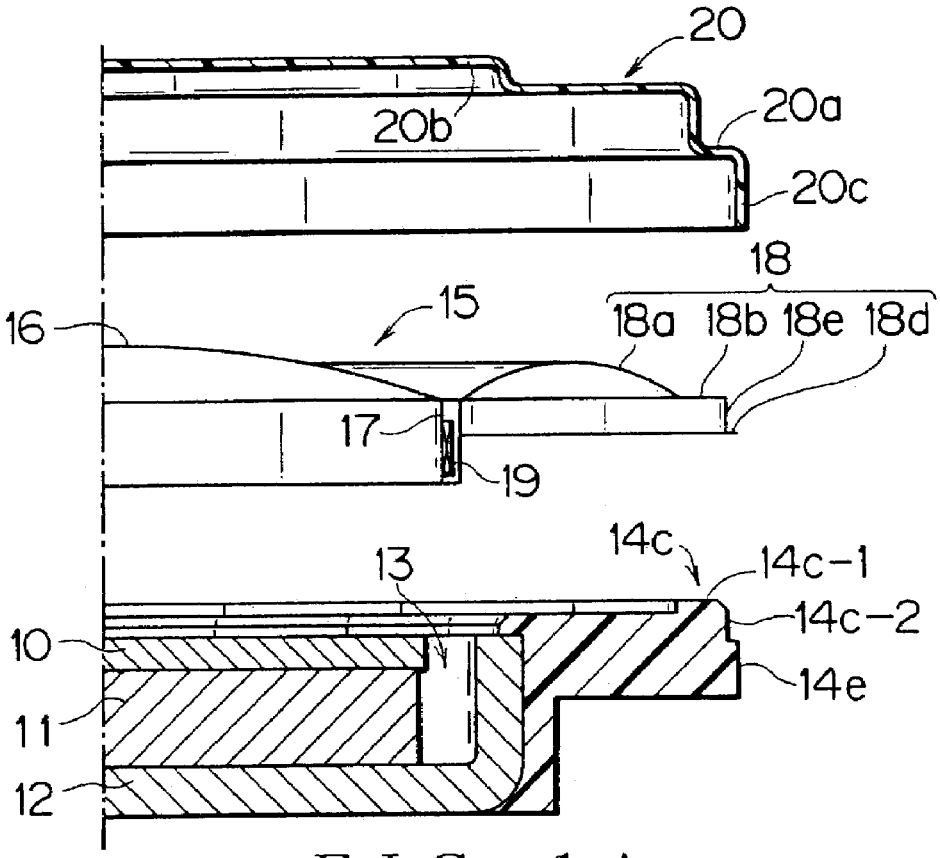
FIG. 1A is an exploded half-sectional view showing one embodiment of a speaker in which a diaphragm is embedded according to this invention.
Figure 1B:
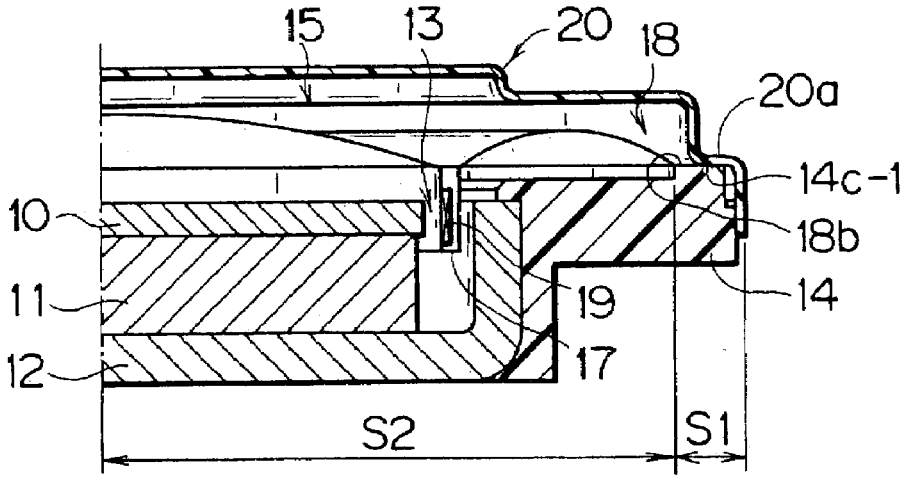
FIG. 1B is a half-sectional view of the speaker in FIG. 1A

One embodiment of this invention will now be described with reference to the attached drawings. Each of FIGS. 1A and 1B is a view showing one embodiment of a speaker in which a diaphragm is embedded according to this invention. FIG. 1A shows an exploded half-sectional view of the speaker. FIG. 2B shows a half-sectional view of the speaker. In these figures, parts equivalent to the parts in FIGS. 2A and 2B are denoted by the same reference numerals so as to omit detailed explanations.

Figure 2A:
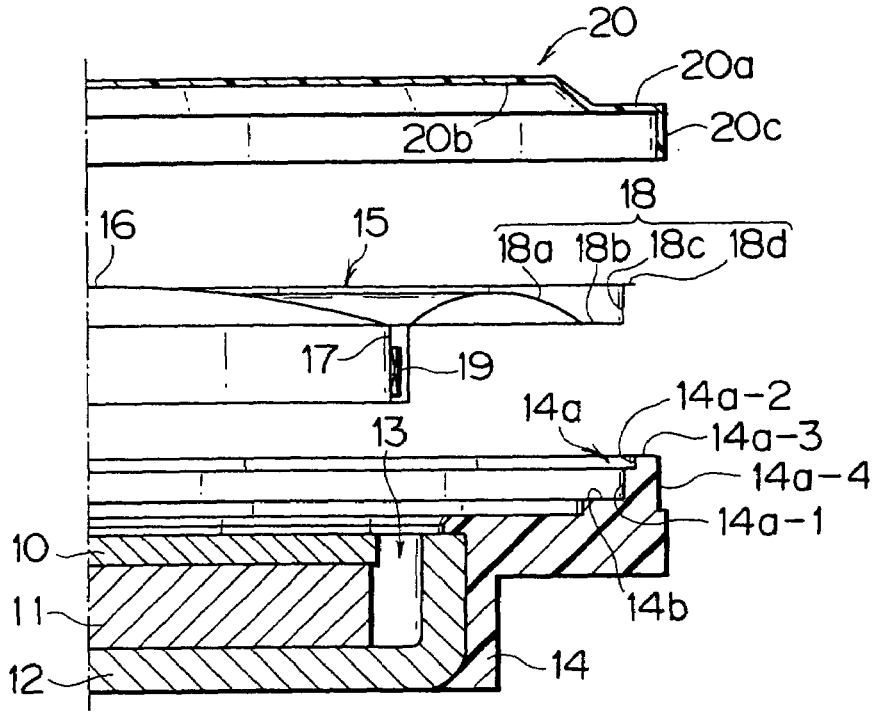
PRIOR ART FIG. 2A
FIG. 2A is an exploded half-sectional view of one example of the conventional dome speaker.
Figure 2B:
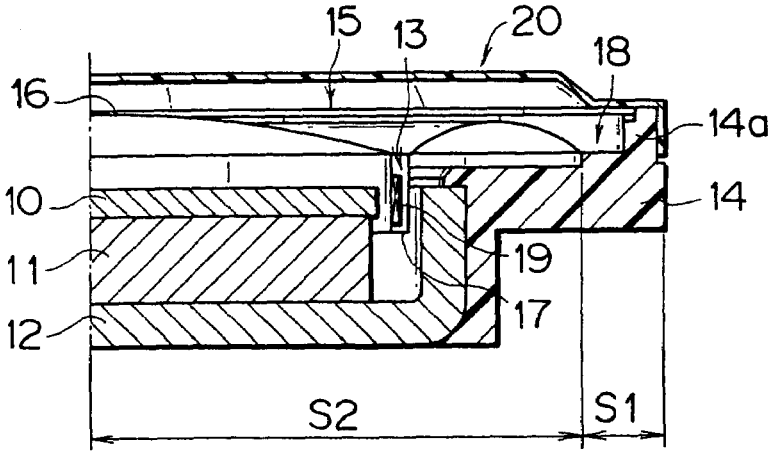
PRIOR ART FIG. 2B
FIG. 2B is a half-sectional view of the example of the conventional dome speaker.

A difference in between the speaker of this invention and a conventional speaker as shown in FIGS. 2A and 2B is a shape of the frame 14. Heretofore, the frame 14 has the convex portion 14*a* (FIGS. 2A and 2B) located outward from the diaphragm 15. However, the frame 14 of this invention has a convex portion 14*c* located inward from the diaphragm 15. A leveling surface 14*c*-1 for supporting the edge damper frame 18*b* is provided at the top of the convex portion 14*c*.

Further, a shape of the edge 18 of the diaphragm 15 is also different from the conventional one. Heretofore, the edge 18 has the rising portion 18*c* which stands up substantially perpendicular to the frame-cover 20 from the outer peripheral edge of the edge damper frame 18*b*. However, the edge 18 of this invention has a slope 18*e* which sits down substantially perpendicular to the frame 14 from the outer peripheral edge of the edge damper frame 18*b*. This slope 18*e* is provided alongside an outer side surface 14*c*-2 of the convex portion 14*c*. A shape of the diaphragm 15 is a substantial circle or oval in plane view.

Further, a locking portion 18*d* is provided at a bottom edge of the slope 18*e*. This locking portion 18*d* is provided so as to abut against the inner side surface of the locking portion 20*c* of the frame-cover 20.

In such structure, when the slope 18*e* is located alongside the outer side surface 14*c*-2 of the convex portion 14*c* provided on the frame 14, centers of the diaphragm 15 and the frame assembly are aligned with no misalignment, so that the diaphragm 15 is to be attached to the frame assembly in the correct position.

Further, when the edge damper frame 18*b* is located alongside the leveling surface 14*c*-1 provided at the top of the convex portion 14*c*, the concave portion 17 is not located outside the magnetic gap 13, so that the diaphragm 15 is to be attached to the frame assembly in the correct position. In other words, the edge damper frame 18*b* locates a position of the diaphragm 15 corresponding to the frame 14 in perpendicular direction. Moreover, with the locking portion 18*d* abutting against the inner side surface of the locking portion 20*c* of the frame-cover 20, the diaphragm 15 is supported more firmly.

Another difference in between the speaker of this invention and a conventional speaker as shown in FIGS. 2A and 2B is a shape of the frame-cover 20. The outer peripheral surface 20*a* of the frame-cover 20 is located nearer by two steps than the inner surface 20*b* of the frame-cover 20. Moreover, in a same manner as the conventional speaker, the locking portion 20*c*, falling substantially perpendicular to the outer peripheral surface 20*a* integrally, is provided at an outer peripheral edge of the outer peripheral surface 20*a*.

Further, the edge damper frame 18*b* is disposed in between the part of the outer peripheral surface 20*a* of the frame-cover 20 and the leveling surface 14*c*-1 of the frame 14 (FIG. 1B). Therefore, the leveling surface 14*c*-1 supports both the edge damper frame 18*b* and the outer peripheral surface 20*a*. Moreover, with the locking portion 20*c* abutting against an outer side surface 14*e*, the frame-cover 20 is supported more firmly.

With such configuration, it is possible to provide a part for supporting the outer peripheral surface 20*a* as the supporting point of the frame-cover 20 and a part for supporting the edge damper frame 18*b* as the supporting point of the diaphragm 15 are provided at a same location (leveling surface 14*c*-1) on the frame 14. Therefore, it is not necessary to provide the part for supporting the edge damper frame 18*b* of the diaphragm 15 and the part for supporting the outer peripheral surface 20*a* of the frame-cover 20 at different positions respectively on the frame 14.

Moreover, according to the speaker of this invention, the slope 18*e* of the diaphragm 15 is extended from the edge damper frame 18*b* toward the frame 14 and provided alongside the outer side surface 14*c*-2 of the convex portion 14*c* of the frame 14. With such configuration, it is not necessary to extend outward from the outer side surface of the slope 18*e*.

Therefore, in the diameter of the whole speaker, the part S1 for supporting the diaphragm 15 and the frame-cover 20 can be larger. And the diameter S2, adding the edge damper 18*a* to the vibration portion 16 of the diaphragm 15 which actually vibrates, can be smaller. Namely, the vibration area can be larger. Therefore, the minimum resonance frequency is to be smaller, so that the speaker can play in base range and have high sensitive sound pressure.

Incidentally, the contents of Japanese Patent Application No. 2002-129054 are hereby incorporated by reference.

Although this invention has been fully described by way of examples with reference to the accompanying drawings, it is to be noted that various changes and modifications can be made in a scope of this invention.

What is claimed is:

1. A speaker comprising:

a diaphragm;

a frame-cover disposed over the diaphragm; and a frame placed underneath the diaphragm and the frame-cover, and having a support portion supporting supporting points of the diaphragm and the frame-cover, said supporting point of the diaphragm being provided at an outer periphery of the diaphragm and being in level to a radial direction of the diaphragm, whereby the supporting point of the diaphragm is disposed in between the supporting point of the frame-cover and the support portion of the frame; and whereby said frame includes a convex portion against the diaphragm extending around an outer periphery of the frame, said diaphragm includes a slope extending at an angle from the outer periphery of the diaphragm toward the frame having an inner side surface alongside an outer side surface of the convex portion of the frame; and said diaphragm includes a locking portion projecting at an angle from said slope towards said frame-cover to abut said frame-cover;

wherein the inner side surface faces a central axis of the speaker and the outer side surface faces away from the central axis of the speaker.

2. A speaker according to claim 1, wherein the slope extends substantially perpendicularly from said diaphragm and said locking portion projects substantially perpendicularly from said slope.

3. A speaker according to claim 2, wherein said slope extends downwardly from said diaphragm.

4. A speaker according to claim 1, wherein said slope extends downwardly from said diaphragm.

5. A speaker comprising:

a diaphragm;

a frame-cover disposed over the diaphragm; and a frame placed underneath the diaphragm and the frame-cover supporting outer peripheries of the diaphragm and the frame-cover, whereby said frame includes a convex portion against the diaphragm extending around an outer periphery of the frame, and said diaphragm includes a slope extending at an angle from the outer periphery of the diaphragm toward the frame and having an inner side surface alongside an outer side surface of the convex portion of the frame;

wherein said diaphragm includes a locking portion projecting at an angle from said slope towards said frame-cover to abut said frame-cover; and wherein the inner side surface faces a central axis of the speaker and the outer side surface faces away from the central axis of the speaker.

6. A speaker according to claim 5, wherein the slope extends substantially perpendicularly from said diaphragm and said locking portion projects substantially perpendicularly from said slope.

7. A speaker according to claim 5, wherein said slope extends downwardly from said diaphragm.

8. A speaker comprising:

a diaphragm;

a frame-cover disposed over the diaphragm; and a frame placed underneath the diaphragm and the frame-cover, and having a support portion supporting supporting points of the diaphragm the frame-cover, said supporting point of the diaphragm being provided at an outer periphery of the diaphragm and being in level to a radial direction of the diaphragm, whereby said frame includes a convex portion against the diaphragm extending around an outer periphery of the frame, said diaphragm includes a slope extending at an angle from the outer periphery of the diaphragm toward the frame and having an inner side surface alongside an outer side surface of the convex portion of the frame, the support portion of the frame is provided at a top of the convex portion, and the supporting point of the diaphragm is disposed in between the supporting point of the frame-cover and the support portion of the frame;

whereby said diaphragm includes a locking portion projecting at an angle from said slope towards said frame-cover to abut said frame-cover; and wherein the inner side surface faces a central axis of the speaker and the outer side surface faces away from the central axis of the speaker.

9. A speaker according to claim 8, wherein the slope extends substantially perpendicularly from said diaphragm and said locking portion projects substantially perpendicularly from said slope.

10. A speaker according to claim 8, wherein said slope extends downwardly from said diaphragm.

11. A diaphragm comprising a slope being extended at an angle from an outer periphery of the diaphragm toward a frame for supporting the diaphragm, and including an inner side surface alongside an outer side surface of a convex portion of the frame, said convex portion being provided around an outer periphery of the frame against the diaphragm;

whereby said diaphragm includes a locking portion projecting at an angle from said slope towards a frame-cover disposed over the diaphragm so that the locking portion abuts said frame-cover; and wherein the inner side surface faces a central axis of the diaphragm and the outer side surface faces away from the central axis of the diaphragm.

12. A diaphragm according to claim 11, wherein the slope extends substantially perpendicularly from said diaphragm and said locking portion projects substantially perpendicularly from said slope.

13. A diaphragm according to claim 11, wherein said slope extends downwardly from said diaphragm.

* * * * *